US006855888B2

(12) United States Patent
Jacke

(10) Patent No.: US 6,855,888 B2
(45) Date of Patent: Feb. 15, 2005

(54) CABLE TERMINAL

(75) Inventor: Joachim Jacke, Paderborn (DE)

(73) Assignee: Phoenix Contact GmbH & Co., Blomberg (DE)

( * ) Notice: Subject to any disclaimer, the term of this patent is extended or adjusted under 35 U.S.C. 154(b) by 182 days.

(21) Appl. No.: 09/924,871

(22) Filed: Aug. 9, 2001

(65) Prior Publication Data

US 2002/0029895 A1 Mar. 14, 2002

(30) Foreign Application Priority Data

Aug. 9, 2000 (DE) ..... 100 39 632
Jan. 26, 2001 (DE) ..... 101 03 744

(51) Int. Cl.[7] ..... H01R 4/00; H01R 11/20; H01R 13/58

(52) U.S. Cl. ..... 174/84 R; 174/88 R; 439/427; 439/462

(58) Field of Search ..... 174/74 R, 75 R, 174/75 D, 77 R, 79, 82, 84 R, 88 R, 93, 94 R; 439/701, 427, 274, 275, 279, 587, 588, 462, 88

(56) References Cited

U.S. PATENT DOCUMENTS 2,639,312 A * 5/1953 Kerwin ..... 174/138 F
3,221,292 A 11/1965 Swanson et al.
3,951,503 A * 4/1976 Caulkins ..... 439/427
4,241,967 A * 12/1980 Collins ..... 439/589
4,339,166 A * 7/1982 Dayton ..... 439/393
4,441,781 A * 4/1984 Forney et al. ..... 439/502
4,464,540 A * 8/1984 Reeder ..... 174/35 C
4,664,461 A * 5/1987 Schubert et al. ..... 439/587
4,676,577 A * 6/1987 Szegda ..... 439/584
4,758,174 A * 7/1988 Michaels et al. ..... 439/281
4,832,615 A * 5/1989 Thakrar et al. ..... 439/272
4,960,389 A * 10/1990 Frantz et al. ..... 439/404
4,969,839 A * 11/1990 Nilsson ..... 439/395
5,295,866 A * 3/1994 Kroger et al. ..... 439/589
5,463,187 A * 10/1995 Battle ..... 174/88 R
5,484,300 A * 1/1996 Whitney et al. ..... 439/207
5,755,589 A * 5/1998 Koch ..... 439/427
5,760,332 A * 6/1998 Rocci et al. ..... 174/84 R
5,823,811 A * 10/1998 Blanchfield et al. ..... 439/274
5,989,056 A * 11/1999 Lange et al. ..... 439/412
6,069,320 A * 5/2000 Rocci et al. ..... 174/84 R
6,107,574 A * 8/2000 Chang et al. ..... 174/77 R
6,444,914 B1 * 9/2002 Su ..... 174/84 R

FOREIGN PATENT DOCUMENTS

DE 40 09 674 10/1991
DE 44 18 259 8/1995
DE 298 17 679 2/1999
DE 198 30 707 3/2000
GB 2 104 306 A * 3/1983 ..... H02G/15/00

* cited by examiner

*Primary Examiner*—William H. Mayo, III
(74) *Attorney, Agent, or Firm*—Nixon Peabody LLP; David S. Safran

(57) ABSTRACT

Cable terminal for end-face connection of the conductors of a preferably multicore cable. The cable terminal includes a plug part provided with contact elements, a core holding and guiding part, and a cable receiver. The core holding and guiding part includes core guidance channels, and the plug part and the and the cable receiver can be connected to one another. In the assembled state, the core holding and guiding part is located between the plug part and the cable receiver. Alignment of the individual cores to the contact elements of the plug part is accomplished by the core holding and guiding part which includes a first section of soft material, and a second section of hard material. In the first section, core guidance channels is provided while in the second section, a positioning aid is formed for exact alignment of the conductors to the contact elements.

20 Claims, 5 Drawing Sheets

CABLE TERMINAL

BACKGROUND OF THE INVENTION

1. Field of the Invention

The present invention relates to cable terminals for end-face connection of the conductors of a multicore cable, the cable terminal having a plug part and a cable receiver that can be connected to one another, especially screwed to one another. In particular, the present invention relates to such cable terminals where the plug part is provided with contact elements and a core holding and guiding part with guidance channels where in the assembled state, the core holding and guiding part is located between the plug part and the cable receiver.

2. Description of Related Art

Initially, it will be explained below the meaning of the terms used herein below both with respect to the prior art and the present invention as well.

a) The term "cable" means an electrical line which has at least one core, but generally several cores. If there are several cores, it is a multicore cable. For cables with only one core, it is a single-core cable.

b) The cores of a cable includes a conductor and core insulation.

c) In one cable, the conductors are provided with core insulation which insulate the conductors. If there are several cores, the several cores, in their totality, are surrounded by other insulation such as the cable insulation. For a single-core cable, there is no other insulation besides the core insulation.

It was stated above, the invention relates to a cable terminal or joining device for end-face connection of the conductors of a multicore cable. Here, the cable can be connected to an electrical device or can be joined in an electrically conductive manner to a second cable. If the cable is connected to an electrical device, it is a cable terminal. If two cables are to be connected to one another, it is a joining device. Regardless of whether it is a terminal or a joining device, the cable or conductor is always connected by a contact element and thus, the joining device which joins two cables is also considered herein as a terminal. As such, the embodiment of the present invention is shown where the terminal connects a cable to an electrical device. However, the terminal as used herein is can be used to connect two cables as well and hence, the term terminal also refers to the joining device in the present application.

In a terminal for electrically conductive connection of a cable to an electrical device, the electrical device should be understood generally. In particular, the expression "electrical device" also includes electrical and electronic components, means and devices.

It was stated initially that the cable terminal is intended for end-face connection of the conductors of a multicore cable. First of all, it is conventional in practice for multicore cables to be connected. However, the cable terminal can also be used for those cables which have only one core.

With the initially described cable terminal, cables are generally connected in which the cable insulation, but not the core insulation of the individual cores, has been removed before connection. The cable terminal thus enables connection of unstripped conductors. Possibilities for connecting unstripped conductors are already known from the prior art. For this purpose, so-called insulation piercing connecting devices or insulation displacement terminal devices are used in which the contact elements, which are generally made as contact blades, cut into the core insulation laterally from outside until contact is made with the conductor. In addition, there is a second possibility for connecting unstripped conductors in which the contact elements which are generally made as contact spikes do not pierce the core insulation, but penetrate into the conductor and/or the core insulation from the end face of the cores roughly in the direction of the lengthwise axis of the cores, and make contact with the conductor.

In the cable terminal to be formed with the present invention, the second possibility is used, i.e. the core insulation is not cut from the side, but the conductors are connected from the end face. In doing so, in this connection, stranded conductors are generally used. Thus, the contact element penetrates between the individual strands of the conductor. As a result of the restoration force of the core insulation, there is a clamping force sufficient for making electrical contact between the individual strands of the conductor and the contact element which has penetrated into the conductor.

German patent 44 18 259 discloses a cable terminal of the type under consideration in which the core holding and guiding part consists of a plug-side gland and a cable-side end part. In the installed state of the cable terminal, the gland is pushed into a corresponding recess in the plug part. The alignment of the individual conductors to the contact elements takes place by there being four axially parallel channels for holding the cores in the core holding and guiding part and they are flush with the contact elements in the installed state. Here, the inside diameter of the channels is slightly less than the outside diameter of the cores, by which on the one hand, clamping of the cores takes place, and on the other, via the corresponding alignment of the gland to the contact elements, the cores are also aligned to the contact elements. In addition, the cable-side end part of the core holding and guiding part is made elastic by the lengthwise slots located in the end part, by which clamping of the individual cores can be achieved for forces acting accordingly radially on the end part.

In the above described known cable terminal, exact alignment of the individual cores to the contact elements is dependent on the production tolerances of the gland of the core holding and guiding part to the corresponding recess of the plug part. In addition, for different cables with different diameters of the cores, different core holding and guiding parts are necessary. If a cable which is used has cores with smaller diameters than the core guidance channels, the alignment of the cores to the contact elements is inadequate.

German utility model 298 17 679 likewise discloses a cable terminal of the type under consideration, but which enables connection of different cables with different core cross sections. To do this, the core holding and guiding part consists of a rubber elastic material with axially parallel channels located in it. By squeezing the rubber elastic material together in the radial direction, the channel cross section is matched to the actual cross section of the inserted cores. But here, the disadvantage is that by squeezing together the rubber elastic material of the core holding and guiding part, not only is the channel cross section changed, but also the alignment of the channel middle to the contact elements are changed. Thus, insertion of cores with different diameters into the core guidance channels of the core holding and guiding part is indeed possible, but the accuracy of alignment of the inserted cores to the contact elements likewise, depends on the core cross sections used so that exact alignment cannot always be ensured. In addition, the alignment of the cores is adversely affected by aging and settling phenomena of the rubber elastic core holding and guiding part.

SUMMARY OF THE INVENTION

Thus, one primary object of this present invention is to make available a cable terminal for end-face connection of the conductors of a multicore cable in which alignment of the individual cores to the contact elements of the plug part is accomplished as precisely as possible. In addition, within certain limits, different cables with different core cross sections may be connected with the same cable terminal.

The aforementioned object is first of all achieved in that the core holding and guiding part includes a first section of soft material and a second section of hard material. The core guidance channels in the first section, and a positioning aid in the second section are formed for exact alignment of the conductors to the contact elements. The "soft material" means material which is relatively elastic, whereas "hard material" means material having little elasticity.

The embodiment of the core holding and guiding part in accordance with the present invention enables connection of different cables with different core cross sections. By the arrangement of the core guidance channels in the first section of the core holding and guiding part which consists of soft material, especially of a soft plastic such as a thermoplastic elastomer, the cross section of the core guidance channels can be reduced to the smaller cross section of the cores by radial pressure on this first section. In doing so, as a result of the elastic properties of the first section, sufficient clamping of the individual cores into the core guidance channels can be achieved so that the cores are prevented from slipping back when the contact elements penetrate into the cores. Moreover, the radial pressure on the first section provides the contact force necessary for making electrical contact between the individual strands of a conductor and the contact element which has been pushed into the conductor from the end face. Thus, the force acting radially on the core insulation additionally supports the restoration force of the core insulation. Because the alignment of the cores or the conductors to the contact elements is accomplished by a positioning aid formed in the second section of the core holding and guiding part, exact alignment of the conductors to the contact elements is not influenced by the core guidance channels being pressed together. Because the second section consists of a hard plastic such as a hard thermoplastic or a ceramic material or other hard insulating material, the positioning aid is much less sensitive to aging and settling phenomena.

The thermoplastic elastomers for the first section can be, for example, a natural rubber or a silicone rubber, and the first section can be produced by vulcanization.

According to one especially preferred embodiment of the invention, the first section is made in one piece from thermoplastic elastomer and the second section is made in one piece from thermoplastic. Here, the core holding and guiding part can be produced in a two-component injection molding process so that the two sections are connected to one another materially. The advantage of this core holding and guiding part which is made as a composite injected part is that in this way, it is easily ensured that the first section and the second section cannot slide or turn relative to one another.

According to one preferred embodiment, the positioning aid has holes assigned to the individual core guidance channels, the holes, as viewed from the core guidance channels, having a tapering cross section. The holes can be made funnel-shaped or cone-shaped. By this configuration of the positioning aid, solely by pushing the cores through the core guidance channels into the tapering holes, "self-alignment" of the inserted cores is accomplished. Substantially exact, permanent alignment of the center lines of the cores, regardless of their diameter within a range, is accomplished by the funnel-shaped or cone-shaped execution of the holes. If the contact elements of the plug part are arranged such that they are centered to the holes of the positioning aid, it is ensured that the contact elements also meet the end face of the cores to be connected in the center.

The arrangement and alignment of the contact elements centered to the holes of the positioning aid can advantageously be accomplished especially easily by the holes of the first tapering area which adjoins the core guidance channels having a second area of constant diameter and a third, widening area. The positioning aid is then used not only to align the cores, but at the same time, also to align the contact elements so that exact alignment of the cores to the contact elements is accomplished by the hole overall and thus, all three areas having a coincident center line.

It was stated above that the holes have a first tapering area, a second area of constant diameter, and a third widening area. Here, the first and the third area are made mirror-symmetrical to one another and even border one another so that the middle second area is more or less omitted or only has a negligible length. The minimum diameter of the first tapering area must always be less than the smallest diameter of the core to be connected so that the first area of the hole always forms a stop for a core which has been pushed through a core guidance channel. Conversely, the smallest diameter of the third area must always be greater than the diameter of the contact elements so that the contact elements project through the holes into the area of the core guidance channels. Ideally, the smallest diameter of the third area corresponds exactly to the outside diameter of the contact elements.

In the cable terminal in accordance with the present invention, the core holding and guiding part described in particular above is essential to the invention. The subject matter of this invention is thus not only the cable terminal, but also the core holding and guiding part for use in a cable terminal. For the specific embodiment of the cable terminal, especially of the plug part and cable receiver, there are various possibilities. What is functionally important is simply that the plug part and/or the cable receiver are made such that on the one hand, the plug part and the cable receiver can be connected to one another, and that on the other hand, radial forces are applied especially to the first section of the core holding and guiding part which consists of a soft, elastic material.

According to one advantageous embodiment of the cable terminal or joining means as claimed in the invention, there is a polarization element which acts between the plug part and the cable receiver. For this purpose for example the second section has a groove and the plug part has an assigned spring. Of course, the groove can also be assigned to the plug part and the spring to the second section or the polarization element can be made differently. This polarization element ensures polarized connection of a cable to the contact elements of the plug part.

According to one advantageous embodiment of the cable terminal in accordance with the present invention, the cable receiver has a sleeve with an outside thread and the plug part has a union nut with an inside thread which corresponds to the outside thread of the sleeve. Thus, to assemble the cable terminal in the invention, the cable receiver and the plug part can be easily screwed together, the core holding and guiding part being located between the cable receiver and the plug part.

The radial force on the core holding and guiding part can be easily produced by the plug part's having a sleeve part which is located within the union nut, the sleeve part in the installed state surrounding the core holding and guiding part and the inside diameter of the sleeve part being at least partially smaller than the outside diameter of the core holding and guiding part. A radial force can thus, be applied to the first section of the core holding and guiding part by the arrangement of this sleeve part in the plug part in which the core guidance channels are squeezed together and the cores which have been inserted into the core guidance channels are secured. Especially advantageous clamping of the cores in the core guidance channels in the vicinity of the positioning aid is achieved by the inside diameter of the sleeve part widening in the direction to the core holding and guiding part. In other words, the sleeve part has the smallest diameter on the side facing away from the cable receiver.

In particular, there are a host of possibilities for embodying and developing the above described cable terminal in accordance with the present invention. These and other advantages and features of the present invention will become more apparent from the following detailed description of the preferred embodiments of the present invention when viewed in conjunction with the accompanying drawings.

DETAILED DESCRIPTION OF THE INVENTION

Initially, reference is made to the definitions provided previously. In addition, as also noted above, the term "cable terminal" as used herein refer to both terminals which connect a cable to an electrical device as well as to joining devices that connect two cables together.

Figure 1:
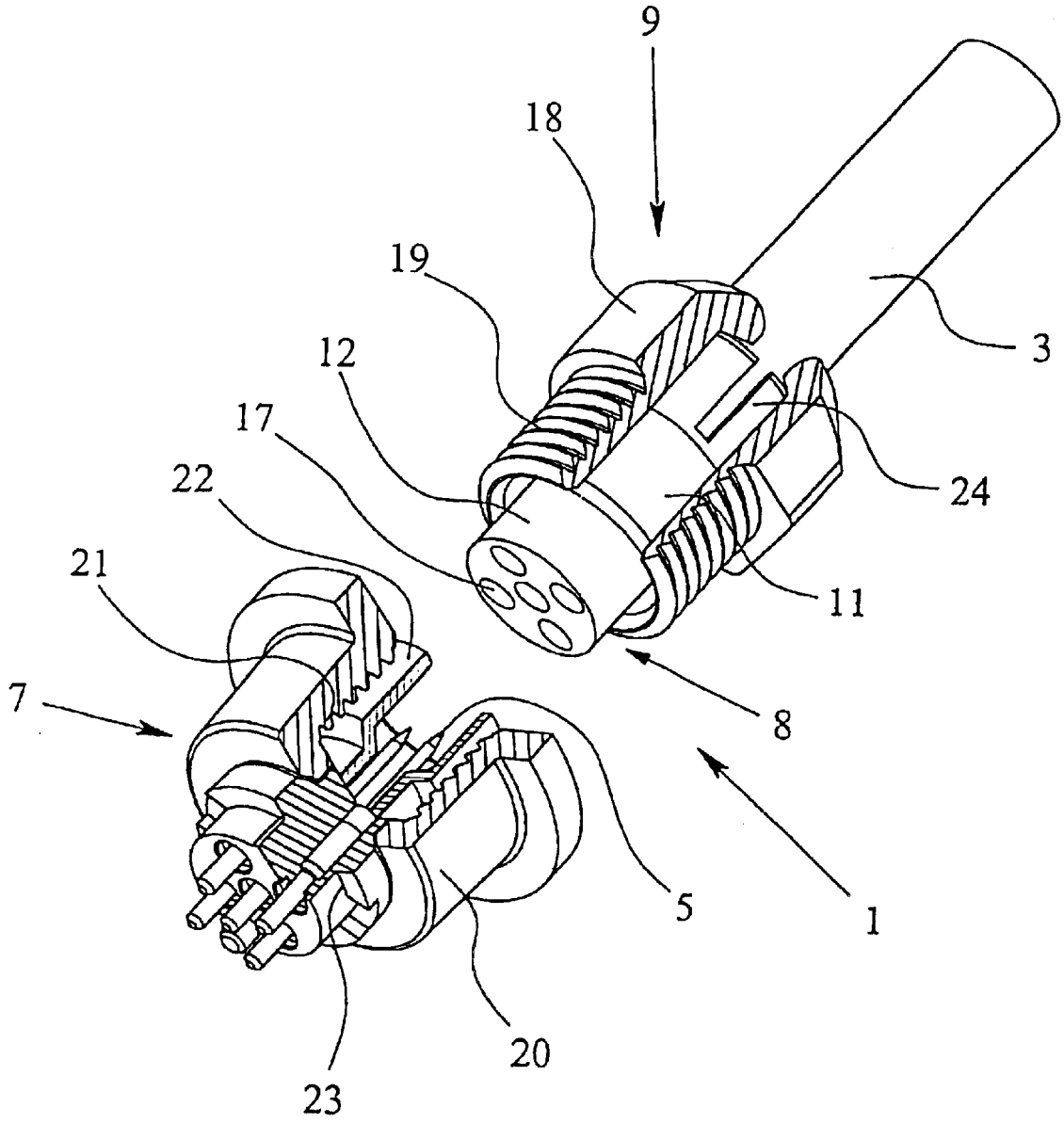
FIG. 1 shows a partial cross-sectional perspective view of a cable terminal in accordance with the present invention in an opened, unassembled state.
Figure 2:
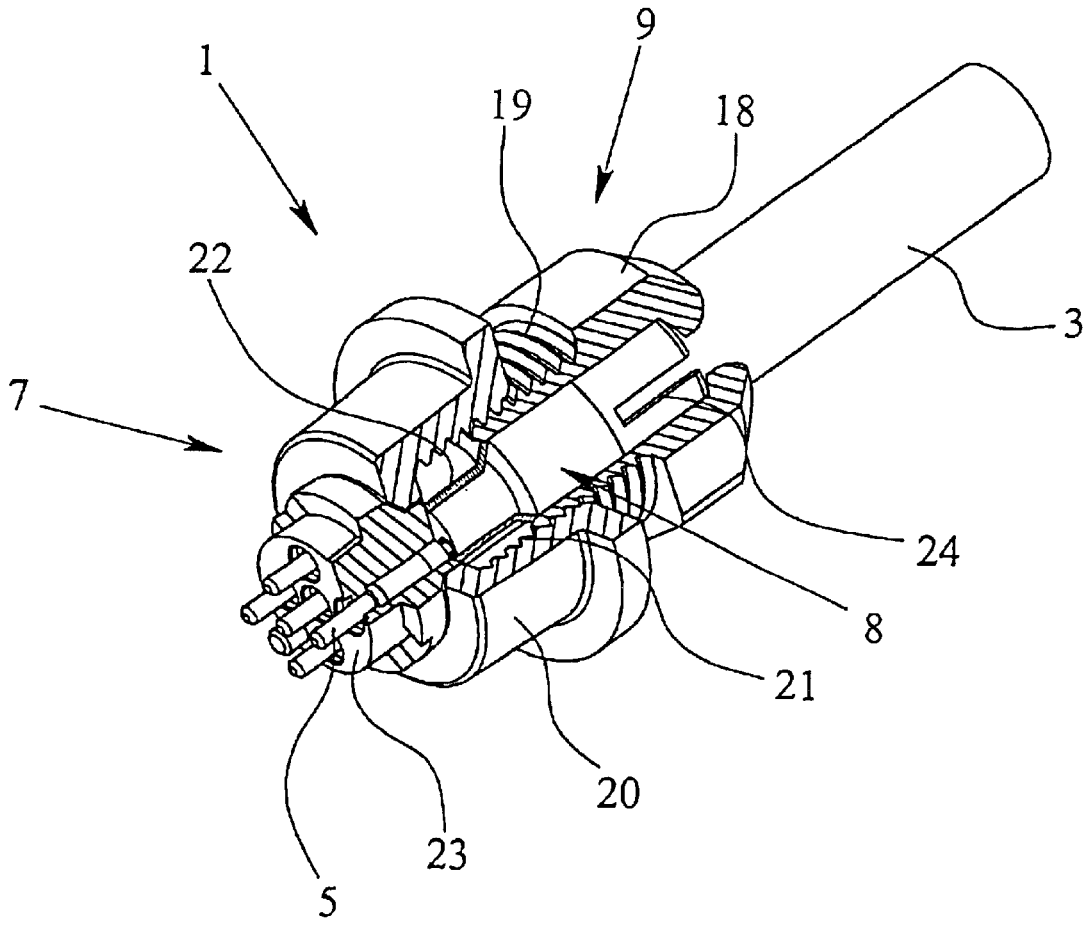
FIG. 2 shows a perspective view of the cable terminal corresponding to FIG. 1 in the contact-making, partially assembled state.
Figure 3:
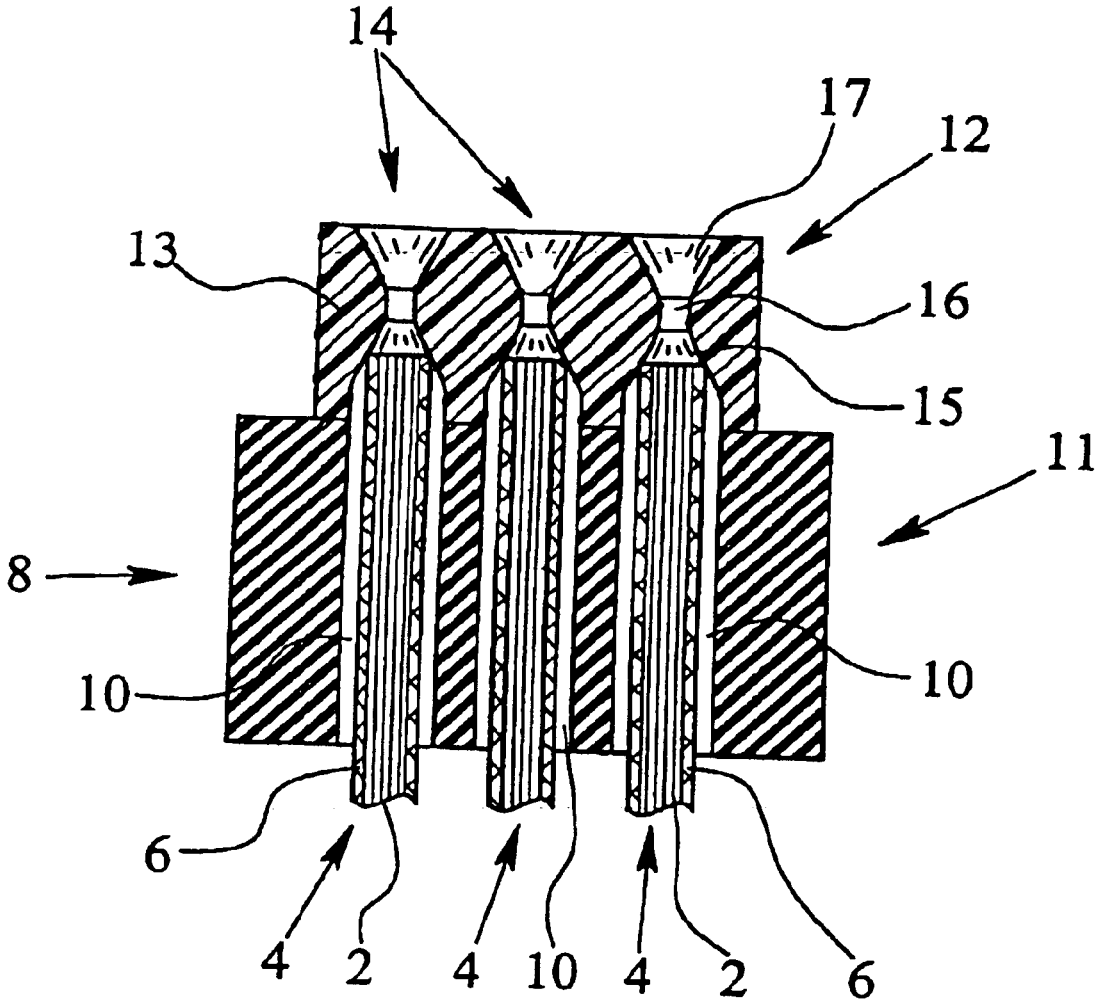
FIG. 3 shows a schematic cross-sectional view of the core holding and guiding part of the cable terminal in accordance with the present invention.
Figure 4:
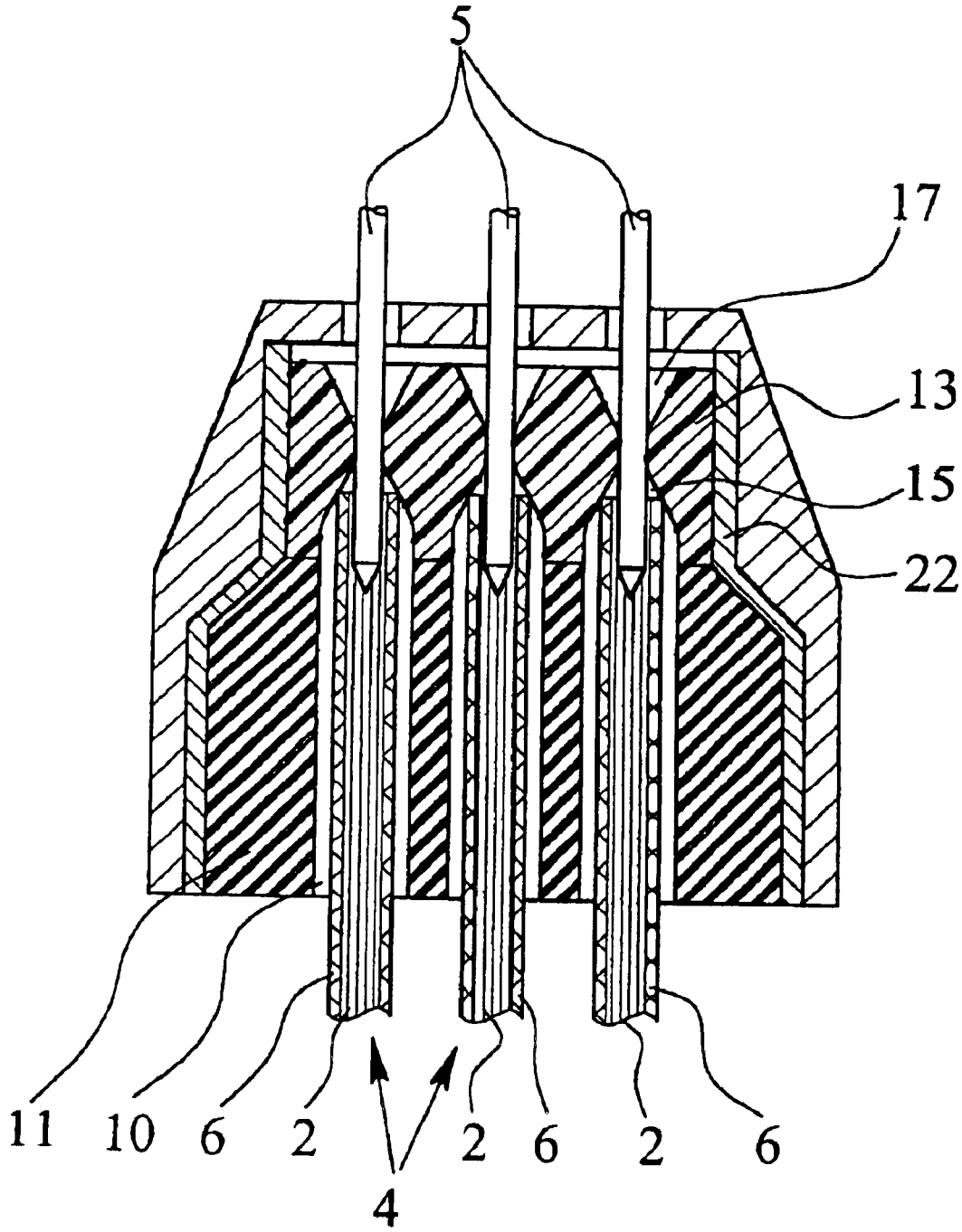
FIG. 4 shows the core holding and guiding part of a cable terminal in accordance with the present invention with the inserted cores having made contact with the contact elements.

FIGS. 1 and 2 show one embodiment of a cable terminal 1 in accordance with the present invention for end-face connection of the conductors of a multicore cable 3 which are more clearly shown in FIGS. 3 and 4, the multicore cable having a total of five cores 4. The cable terminal 1 enables connection of unstripped conductors 2 shown in FIGS. 3 and 4 by the contact elements 5 penetrating into the conductor 2 from the end face of the conductor 2 roughly in the direction of the lengthwise axis of the conductor 2 in the manner shown in FIG. 4. In doing so, generally stranded conductors 2 are used so that the contact element 5 penetrates between the individual strands of the conductor 2. As a result of the restoration force of the core insulation 6 which surround the individual conductors 2, there is a clamping force sufficient to make electrical contact between the individual strands of the conductor 2 and the contact element 5 which has penetrated the conductor 2.

As seen from the various figures, the cable terminal 1 of the illustrated embodiment includes a plug part 7 in which the contact elements 5 are located, a core holding and guiding part 8, and a cable receiver 9. To connect a cable 3 to the cable terminal 1, the individual cores 4 are pushed into the core guidance channels 10 which are provided in the core holding and guiding part 8. In the embodiment shown in FIGS. 1 and 2, there are a total of five core guidance channels 10 in the core holding and guiding part 8 which are parallel to one another so that for the cable terminal 1 shown, there is provided with a maximum five cores 4 for electrical connection of the cable 3. There are also five contact elements 5 in the plug part 7 corresponding to the five core guidance channels 10 which are present.

Figure 1A:
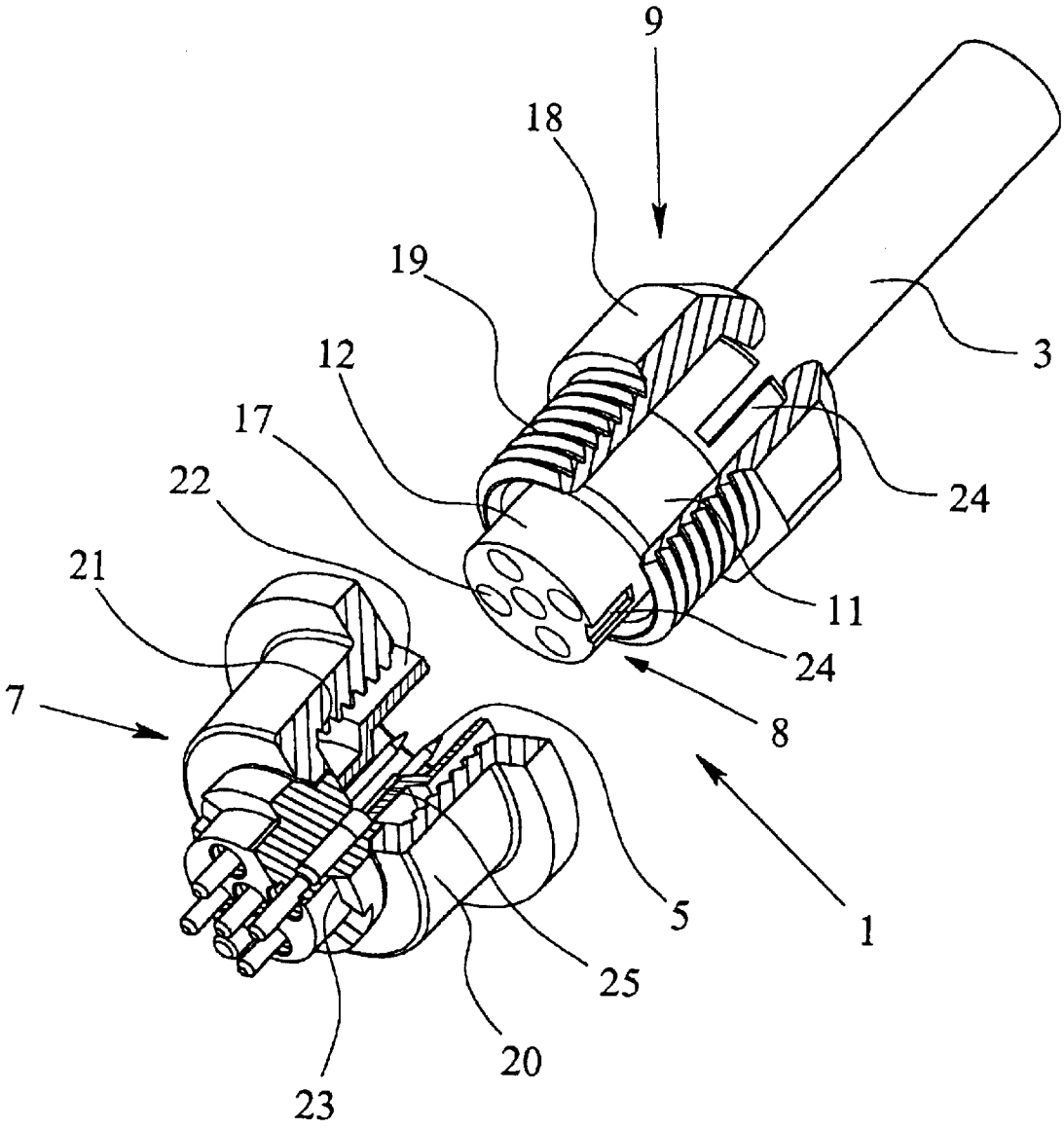
FIG. 1*a* shows a partial cross-sectional perspective view of a cable terminal in accordance with another embodiment of the present invention in an opened, unassembled state.

FIG. 1*a* shows a partial cross-sectional perspective view of the cable terminal 1 shown in FIG. 1 but with an optional polarization element which acts between the plug part 7 and the cable receiver 9 to ensure proper orientation of these components relative to one another so that the proper connection between the contact elements 5 and the conductors can be established. In the illustrated embodiment, the polarization element includes a groove 24 provided on the cable receiver 9 and a corresponding engaging mechanism such as a key or a spring (not shown) in the plug part 7 that engages the groove 24 to properly orient the plug part 7 and the cable receiver 9. Of course, in other embodiments, the groove may be provided on the plug part 7 and the corresponding engaging mechanism may be provided on the cable receiver 9 instead.

FIGS. 3 and 4 show a schematic of the core holding and guiding part 8 which in accordance with the present invention includes a first section 11 of soft material such as a thermoplastic elastomer, and a second section 12 of a hard material such as a hard thermoplastic or ceramic. In the first section 11, there are core guidance channels 10, while the second section 12 of the core holding and guiding part 8 forms the positioning aid 13 for exact alignment of the conductors 2 to the contact elements 5. The core holding and guiding part 8 is preferably produced in a two-component injection molding process so that the core holding and guiding part 8 is in one piece, and the first section 11 is materially connected to the second section 12.

FIG. 3 shows that the diameter of the core guidance channels 10 is greater than the diameter of the cores 4 to be connected. Here, the diameter of the core guidance channels 10 is chosen such that it corresponds to the largest diameter of the cores 4 intended for connection to the cable terminal 1. Because the core guidance channels 10 in the first section 11 of the core holding and guiding part 8 are made of a soft material, the core guidance channels 10 can be pressed together by applying a radial force to the first section 11 of the core holding and guiding part 8 to such an extent that sufficient axial fixing of the individual cores 4 in the core guidance channels 10 is achieved.

The positioning aid 13 of the core holding and guiding part 8 has holes 14 assigned to the core guidance channels 10, the holes 14 having a first tapering area 15 which adjoins the core guidance channels 10, a second area 16 of constant cross section, and a third widening area 17. The first tapering funnel-shaped area 15 of the hole 14 is used for exact positioning of a core 4 which has been pushed through the core guidance channel 10. Because the first area 15 of the hole 16 tapers in a funnel shape, "self alignment" of the inserted cores 4 and thus, also the conductors 2 with which contact is to be made always takes place so that the center line of an inserted conductor 2 always aligns with the center line of the hole 14.

While FIG. 3 shows the core holding and guiding part 8 with the cores 4 inserted but without the contact elements 5, FIG. 4 also shows the contact elements 5 inserted from the opposite direction. In the same way as the areas 15 of the holes 14 cause exact alignment of the cores 4, the conical areas 17 of the holes 14 cause exact alignment of the contact elements 5. If the outside diameter of the contact elements 5 corresponds to the smallest diameter of the hole 14, i.e. the diameter of the middle area 16, a contact element 5 which has been pushed through the hole 14 of the positioning aid 13 always meets the core 4 which has been inserted into the core guidance channel 10 exactly in the center and thus, meets the conductor 2 which is surrounded by the insulation 6 exactly in the center. The embodiment of the positioning aid 13 described in detail above, and the material connection of the first section 11 which has the core guidance channels 10 and the second section 12 of the core holding and guiding part 8 which has the positioning aid 13, ensures that the contact elements 5 always meet the end face of the conductors 2 in the center. In this way then, optimum electrical contact between the conductors 2 and the contact elements 5 is ensured.

One embodiment for assembly of the cable terminal 1 in accordance with the present invention is shown in FIGS. 1 and 2. In the embodiment shown, the cable receiver 9 and the plug part 7 can be screwed to one another via the cable receiver 9 having a sleeve 18 with an outside thread 19, and the plug part 7 having a union nut 20 with an inside thread 21 which corresponds to the outside thread 19 of the sleeve 18. In the assembled state of the cable terminal 1 then, the core holding and guiding part 8 is surrounded by the sleeve 18 and the union nut 20.

The plug part 7 of the illustrated embodiment has an inside sleeve 22 and a contact carrier 23 which holds the contact elements 5. The inside sleeve 22 which form-fittingly surrounds the core holding and guiding part 8 when in the contact-making state, has an inside diameter which is at least partially smaller than the outside diameter of the core holding and guiding part 8. The inside contour of the inner sleeve 22 is preferably chosen such that in the installed state of the cable terminal 1, the first section 11 of the core holding and guiding part 8 is pressed together by the inside sleeve 22 so that the cores 4 which have been pushed into the core guidance channels 10 are clamped tight. In the embodiment of the cable terminal 1 shown in FIGS. 1 and 2, the cable receiver 9 has a clamp cage 24 which acts as strain relief for the inserted cable 3.

In addition to the embodied implementation of the plug part 7 and the cable receiver 9 shown in FIGS. 1 and 2 in which the sleeve 18 is assigned to the cable receiver 9 and the union nut 20 to the plug part 7, an embodiment is also possible in which the union nut is assigned to the cable receiver and the plug part has a sleeve with an outside thread. Likewise, in other embodiments, there can be a sleeve part in the cable receiver which applies a radial force to the core holding and guiding part instead of in the plug part.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

What is claimed is:

1. Cable terminal for end-face connection of at least one multi-strand conductor of a first cable to an electrical device or second cable, comprising:

a plug part having at least one contact element, said at least one contact element having a first end for connection to said electrical device or second cable and a free second end shaped for penetration connection into the strands of the at least one multi-strand conductor of the first cable;

a cable receiver adapted to be connected to the plug part in opposed relationship to the free end of said at least one contact element; and a core holding and guiding part having at least one core guidance channel, the core holding and guiding part being mounted in the cable receiver and being surrounded by the plug part and the cable receiver when the plug part and the cable receiver are connected to one another;

wherein the core holding and guiding part includes a first section of soft material, and a second section of hard material harder than the soft material, the second section being arranged axially with respect to the first section, the at least one core guidance channel being formed in the first section and the second section forming a positioning aid, the at least one core guidance channel and the positioning aid being shaped to align the at least one multi-strand conductor of the cable relative to the free end of the at least one contact element.

2. Cable terminal as claimed in claim 1, wherein the cable is a multicore cable having plurality of cores with a plurality of conductors, the at least one contact element is a plurality of contact elements, and at least one core guidance channel is a plurality of core guidance channels, the plurality of core guidance channels and the positioning aid being shaped to align the plurality of conductors of the multicore cable relative to the free ends of the plurality of contact elements.

3. Cable terminal as claimed in claim 1, wherein the plug part and the cable receiver are connected to one another by screwing the plug part relative to the cable receiver.

4. Cable terminal as claimed in claim 1, wherein the first section is formed from a soft thermoplastic elastomer.

5. Cable terminal as claimed in claim 1, wherein the second section is formed from at least one of a hard thermoplastic and a ceramic material.

6. Cable terminal as claimed in claim 1, wherein the first section and the second section of the core holding and guiding part are formed connected to one another as one integrated piece.

7. Cable terminal as claimed in claim 2, wherein diameter of each of the plurality of core guidance channels corresponds to a largest diameter of the plurality of cores.

8. Cable terminal as claimed in claim 2, wherein the positioning aid has plurality of holes assigned to the plurality of core guidance channels of the core holding and guiding part, the plurality of holes having a tapering cross section.

9. Cable terminal as claimed in claim 8, wherein the plurality of holes of the positioning aid have at least one of funnel shape and conical shape.

10. Cable terminal as claimed in claim 8, wherein the plurality of holes of the positioning aid include a stop for the plurality of cores pushed through the plurality of core guidance channels of the core holding and guiding part.

11. Cable terminal as claimed in claim 8, wherein each of the plurality of holes of the positioning aid have a first tapering area which adjoins one of the plurality of core guidance channels of the core holding and guiding part, a second area of constant diameter, and a third widening area.

12. Cable terminal as claimed in claim 1, further including a polarization element formed by a groove on at least one of the plug part and the cable receiver and a corresponding engagement mechanism sized to engage the groove on the other of the at least one of the plug part and the cable receiver.

13. Cable terminal as claimed in claim 1, wherein the cable receiver includes a sleeve with an outside thread, and the plug part includes a union nut with an inside thread corresponding to the outside thread of the sleeve.

14. Cable terminal as claimed in claim 13, wherein the plug part includes an inside sleeve located within the union nut, the inside sleeve surrounding the core holding and guiding part when the cable receiver is connected to the plug part, the inner sleeve having an inside diameter which is at least partially smaller than an outside diameter of the core holding and guiding part.

15. Cable terminal as claimed in claim 14, wherein the inside diameter of the inside sleeve widens toward an opening that receives the core holding and guiding part.

16. Cable terminal as claimed in claim 2, wherein the plug part includes a contact carrier with plurality of holes for holding the plurality of contact elements, each of the plurality of contact elements having contact spikes on ends facing the core holding and guiding part.

17. Core holding and guiding part for use in a cable terminal for end-face connection of a plurality of conductors of a multicore cable with an electrical device or second cable via a plug part having plurality of contact elements, the core holding and guiding part comprising:

a first section of soft material forming a plurality of core guidance channels; and a second section of hard material harder than the soft material forming a positioning aid, the second section being arranged axially with respect to the first section;

wherein the plurality of core guidance channels and the positioning aid are shaped to align the plurality of conductors of the multicore cable relative to the plurality of contact elements.

18. Core holding and guiding part as claimed in claim 17, wherein the first section is formed from a soft thermoplastic elastomer.

19. Core holding and guiding part as claimed in claim 17, wherein the second section is formed from at least one of a hard thermoplastic and a ceramic material.

20. Core holding and guiding part as claimed in claim 17, wherein the first section and the second section of the core holding and guiding part are formed connected to one another as one integrated piece.

* * * * *